US011786785B2

(12) United States Patent
Kato

(10) Patent No.: US 11,786,785 B2
(45) Date of Patent: Oct. 17, 2023

(54) GOLF CLUB HEAD

(71) Applicant: SUMITOMO RUBBER INDUSTRIES, LTD., Hyogo (JP)

(72) Inventor: Masatoshi Kato, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 17/380,162

(22) Filed: Jul. 20, 2021

(65) Prior Publication Data

US 2022/0032135 A1 Feb. 3, 2022

(30) Foreign Application Priority Data

Aug. 3, 2020 (JP) ..... 2020-131908

(51) Int. Cl.
*A63B 53/04* (2015.01)
*A63B 53/08* (2015.01)

(52) U.S. Cl.
CPC ..... *A63B 53/0437* (2020.08); *A63B 53/0466* (2013.01); *A63B 53/08* (2013.01); *A63B 2053/0491* (2013.01); *A63B 2209/00* (2013.01)

(58) Field of Classification Search
CPC ..... A63B 53/0433; A63B 53/0437; A63B 53/045; A63B 53/0466
USPC ..... 473/324–350
See application file for complete search history.

(56) References Cited

U.S. PATENT DOCUMENTS 1,453,503 A * 5/1923 Holmes ..... A63B 53/0466 473/336
5,435,551 A * 7/1995 Chen ..... A63B 53/04 473/324
6,126,556 A * 10/2000 Hsieh ..... A63B 53/047 473/340
6,440,006 B1 * 8/2002 Johnson ..... A63B 53/0487 473/340
9,987,527 B1 * 6/2018 Myers ..... A63B 53/0408
2003/0125128 A1 * 7/2003 Reeves ..... A63B 53/0487 473/340
2006/0094526 A1 * 5/2006 Reed ..... A63B 53/04 473/328
2007/0265108 A1 * 11/2007 Lin ..... A63B 60/02 473/349
2008/0153619 A1 * 6/2008 Tucker ..... A63B 53/065 473/409
2010/0273574 A1 * 10/2010 Yamamoto ..... A63B 53/0466 473/346

(Continued)

FOREIGN PATENT DOCUMENTS

CN 1720080 A * 1/2006 ..... A63B 53/0466
CN 1720081 A * 1/2006 ..... A63B 53/0466

(Continued)

*Primary Examiner* — Alvin A Hunter
(74) *Attorney, Agent, or Firm* — Greenblum & Bernstein, P.L.C.

(57) ABSTRACT

A golf club head has a hollow portion therein. The golf club head includes a head main body comprising a striking face portion, a crown portion and a sole portion, the head main body being provided with a recess extending in a toe-heel direction of the club head on at least one of the crown portion and the sole portion, and a reinforcing rod being fixed to the recess and extending in the toe-heel direction of the club head.

18 Claims, 9 Drawing Sheets

(56) References Cited

U.S. PATENT DOCUMENTS

| | | | | |
|---|---|---|---|---|
| 2010/0304887 | A1* | 12/2010 | Bennett | A63B 53/0475 473/335 |
| 2010/0331102 | A1* | 12/2010 | Golden | A63B 53/04 473/345 |
| 2012/0094780 | A1* | 4/2012 | Slaughter | A63B 53/047 473/316 |
| 2013/0244808 | A1* | 9/2013 | Bennett | A63B 53/06 473/335 |
| 2014/0274453 | A1* | 9/2014 | Curtis | A63B 53/0466 473/332 |
| 2015/0051012 | A1* | 2/2015 | Galvan | A63B 60/00 473/336 |
| 2015/0065265 | A1* | 3/2015 | Motokawa | A63B 53/04 473/335 |
| 2017/0165533 | A1* | 6/2017 | Knutson | A63B 60/02 |
| 2017/0252614 | A1* | 9/2017 | Yi | A63B 53/0466 |
| 2017/0354852 | A1* | 12/2017 | Bennett | A63B 60/02 |
| 2017/0361185 | A1* | 12/2017 | Henrikson | A63B 53/06 |
| 2018/0099189 | A1* | 4/2018 | Sanchez | A63B 53/0466 |
| 2018/0133565 | A1* | 5/2018 | Hebreo | A63B 53/047 |
| 2019/0290976 | A1* | 9/2019 | Bennett | A63B 60/02 |
| 2022/0032135 | A1* | 2/2022 | Kato | A63B 53/0466 |

FOREIGN PATENT DOCUMENTS

| | | | | | |
|---|---|---|---|---|---|
| CN | 101199893 | A | * | 6/2008 | A63B 53/0466 |
| CN | 102202747 | A | * | 9/2011 | A63B 53/0466 |
| CN | 102281927 | A | * | 12/2011 | A63B 53/04 |
| CN | 102794003 | A | * | 11/2012 | A63B 53/04 |
| CN | 202605659 | U | * | 12/2012 | A63B 53/00 |
| CN | 104338297 | A | * | 2/2015 | A63B 53/02 |
| CN | 209451246 | U | * | 10/2019 | A63B 53/04 |
| CN | 211752306 | U | * | 10/2020 | A63B 53/04 |
| CN | 113491863 | A | * | 10/2021 | A63B 53/04 |
| CN | 215841488 | U | * | 2/2022 | A63B 53/04 |
| FR | 2695836 | A1 | * | 3/1994 | A63B 53/04 |
| JP | H11188123 | A | * | 7/1999 | |
| JP | 2005058461 | A | * | 3/2005 | A63B 53/04 |
| JP | 2007007063 | A | * | 1/2007 | A63B 53/04 |
| JP | 2010-279847 | A | | 12/2010 | |
| JP | 2011125623 | A | * | 6/2011 | A63B 53/04 |
| JP | 2020518361 | A | * | 6/2020 | |
| JP | 2020531089 | A | * | 11/2020 | |
| KR | 100648197 | B1 | * | 11/2006 | |
| TW | M310020 | U | * | 4/2007 | |
| TW | 200911326 | A | * | 3/2009 | A63B 53/0466 |
| WO | WO-2007076304 | A2 | * | 7/2007 | A63B 53/04 |

* cited by examiner

GOLF CLUB HEAD

This application claims the benefit of foreign priority to Japanese Patent Application No. JP2020-131908, filed Aug. 3, 2020, which is incorporated by reference in its entirety.

BACKGROUND ART

Field of the Disclosure

The present disclosure relates to a golf club head having an interior hollow portion therein.

Description of the Related Art

The following Patent document 1 discloses a golf club head having a hollow portion therein. In order to improve rebound performance, the golf club head, on a head outer surface, is provided with a groove that extends along a peripheral edge of the striking face.

Patent Document

[Patent document 1] Japanese Unexamined Patent Application Publication 2010-279847

SUMMARY OF THE DISCLOSURE

In recent years, it has been desired to provide a golf club head with further excellent rebound performance.

The present disclosure has been made in view of the above circumstances and has a major object to provide a golf club head that can be expected to further improve rebound performance.

In one aspect of the disclosure, a golf club head having a hollow portion therein, the golf club head includes a head main body including a striking face portion, a crown portion and a sole portion, the head main body being provided with a recess extending in a toe-heel direction of the club head on at least one of the crown portion and the sole portion, and a reinforcing rod being fixed to the recess and extending in the toe-heel direction of the club head.

In another aspect of the disclosure, the recess may have a groove shape depressed toward the hollow portion.

In another aspect of the disclosure, the recess may be an opening.

In another aspect of the disclosure, the reinforcing rod may include a toe-side fixing portion fixed to a toe side of the head main body, a heel-side fixing portion fixed to a heel side of the head main body, and a bar main body extending in the toe-heel direction between the toe-side fixing portion and the heel-side fixing portion, and the bar main body, at least partially, may be disposed in the recess.

In another aspect of the disclosure, an entire region of the bar main body may be disposed in the recess.

In another aspect of the disclosure, the bar main body and the recess may be separated from one another.

In another aspect of the disclosure, a filler made of an elastic material may be placed between the bar main body and the recess.

In another aspect of the disclosure, the recess may be provided on the sole portion.

In another aspect of the disclosure, the recess may be provided on the crown portion.

DESCRIPTION OF THE PREFERRED EMBODIMENTS

Figure 1:
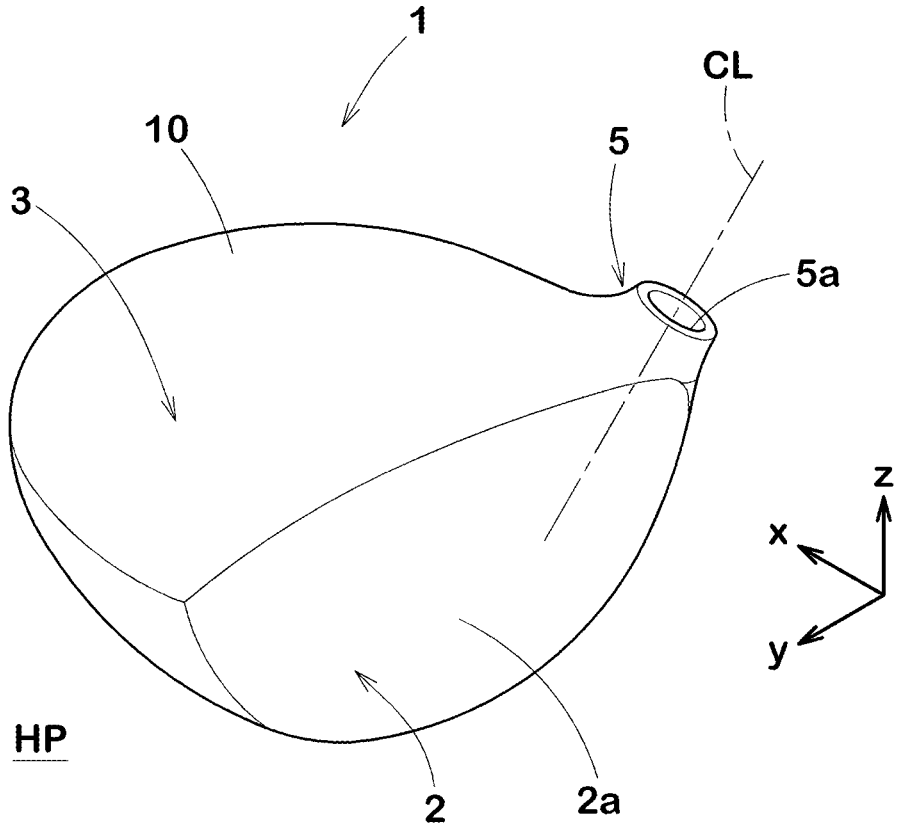
FIG. 1 is a perspective view of a golf club head in accordance with the first embodiment.

Some embodiments of the present disclosure will be explained below with reference to the accompanying drawings. It should be understood that the drawings contain exaggerated expressions and expressions different from the dimensional ratio of the actual structure in order to help the understanding of the present disclosure.

Further, the same or common elements are denoted by the same reference numerals throughout the specification, and duplicate explanations are omitted. Furthermore, the specific configurations shown in the embodiments and drawings are for understanding the contents of the present disclosure, and the present disclosure is not limited to the specific configurations shown.

First Embodiment

FIGS. 1 to 4 are a perspective view, a front view, a plan view and a bottom view of a golf club head 1 (hereinafter simply referred to as "head") in accordance with the first embodiment, respectively. FIG. 5 is an exploded perspective view of the head 1 viewed from below.

[Definition of Reference State]

Figure 2:
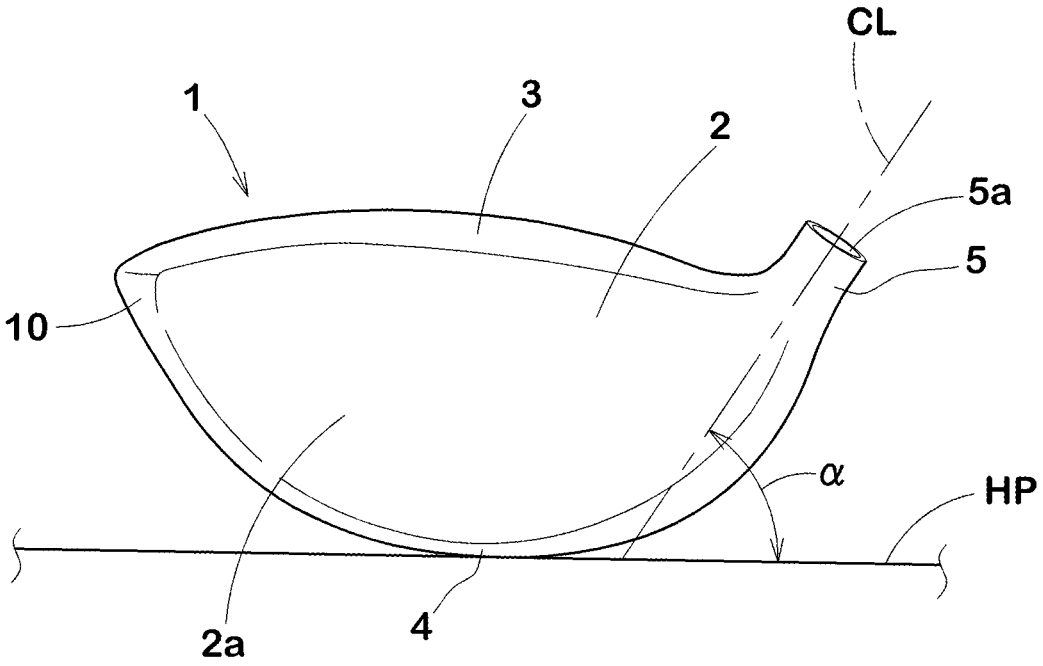
FIG. 2 is a front view of the golf club head in accordance with the first embodiment.
Figure 3:
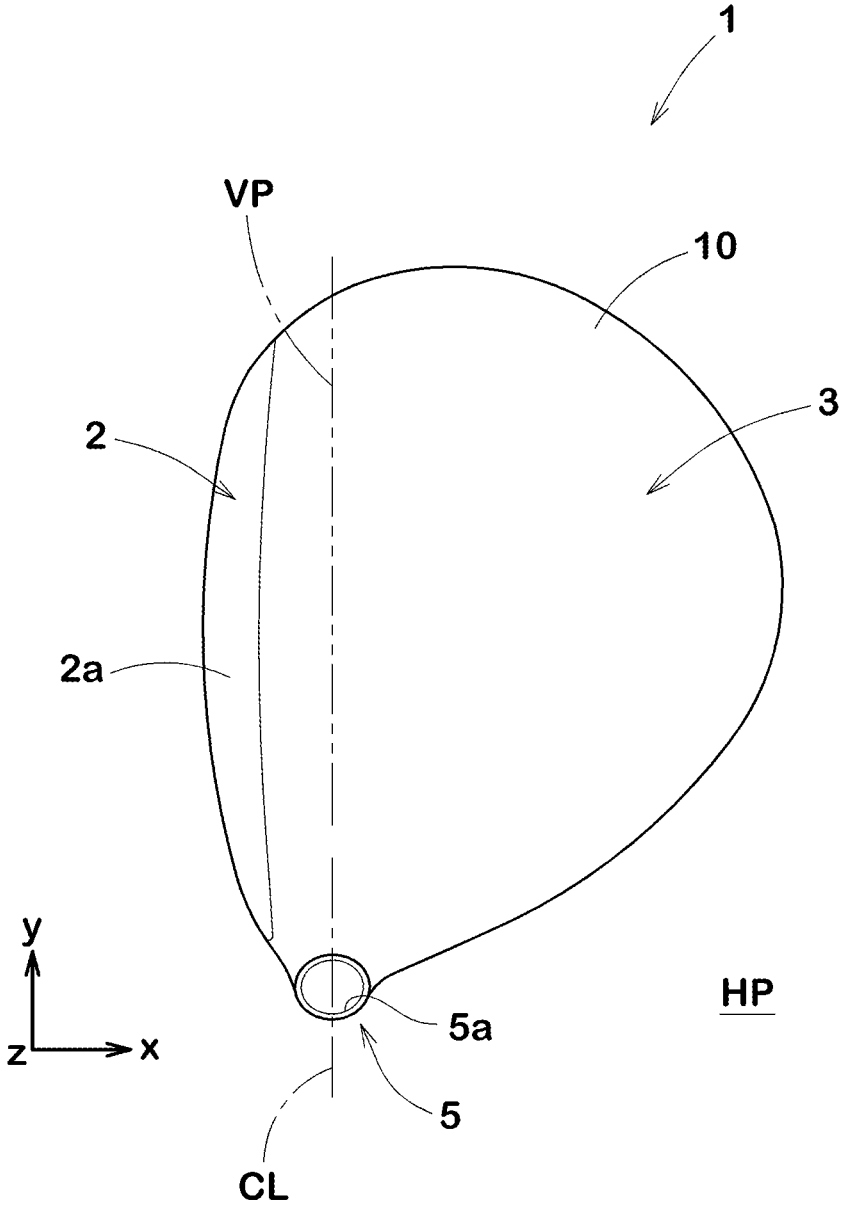
FIG. 3 is a plan view of the golf club head in accordance with the first embodiment.

In FIGS. 1 to 4, the head 1 is oriented in a reference state. As illustrated in FIG. 2, the "reference state" of the head 1 means a state in which the head 1 is placed on a horizontal plane HP at its lie angle $\alpha$ and loft angle (not illustrated) of the head 1. Further, as illustrated in FIG. 3, in the reference state, the head 1 is held at the lie angle $\alpha$ and the loft angle with a virtual shaft central axis CL of the head 1 arranged in a reference vertical plane VP perpendicular to the horizontal plane HP.

As used herein, the "virtual shaft central axis CL" is defined by the central axis of the shaft insertion hole **5*a* of the hosel 5 of the head 1. Unless otherwise noted, all club head dimensions described herein are taken with the head 1** in the reference state.

As used herein, in the reference state of the head 1, "front-rear direction" of the head (x-direction in FIG. 1) is a direction orthogonal to the reference vertical plane VP. In the front-rear direction of the head, a striking face portion 2 side is the front side, and the opposite side is the rear side. Further, "toe-heel direction" of the head (y-direction in FIG. 1) is a direction parallel to both the reference vertical plane VP and the horizontal plane HP. Furthermore, "vertical direction" of the head (z-direction in FIG. 1) is a direction orthogonal to the horizontal plane HP.

[Basic Structure of Head]

The head 1 in accordance with the present embodiment is configured as, for example, a wood type. Such a wood type head includes, for example, various heads called drivers, fairway woods, etc. In other embodiments, the head 1 may be configured as an iron type, a hybrid type, and the like.

Figure 4:
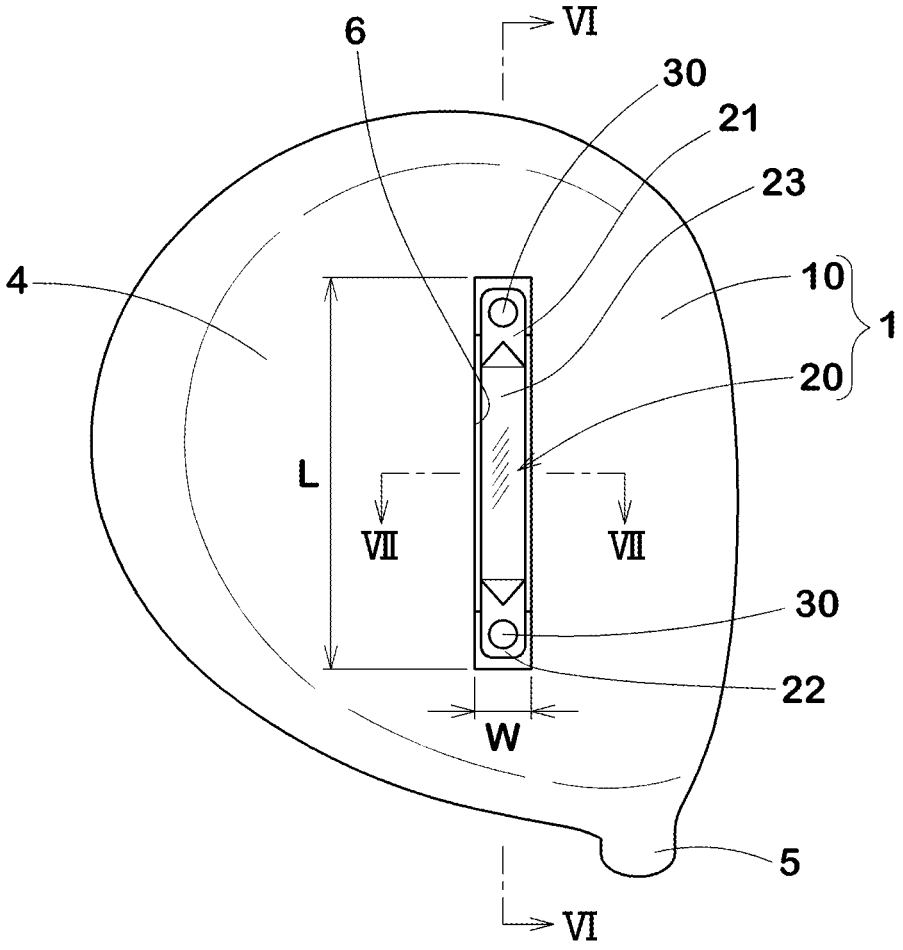
FIG. 4 is a bottom view of the golf club head in accordance with the first embodiment.
Figure 5:
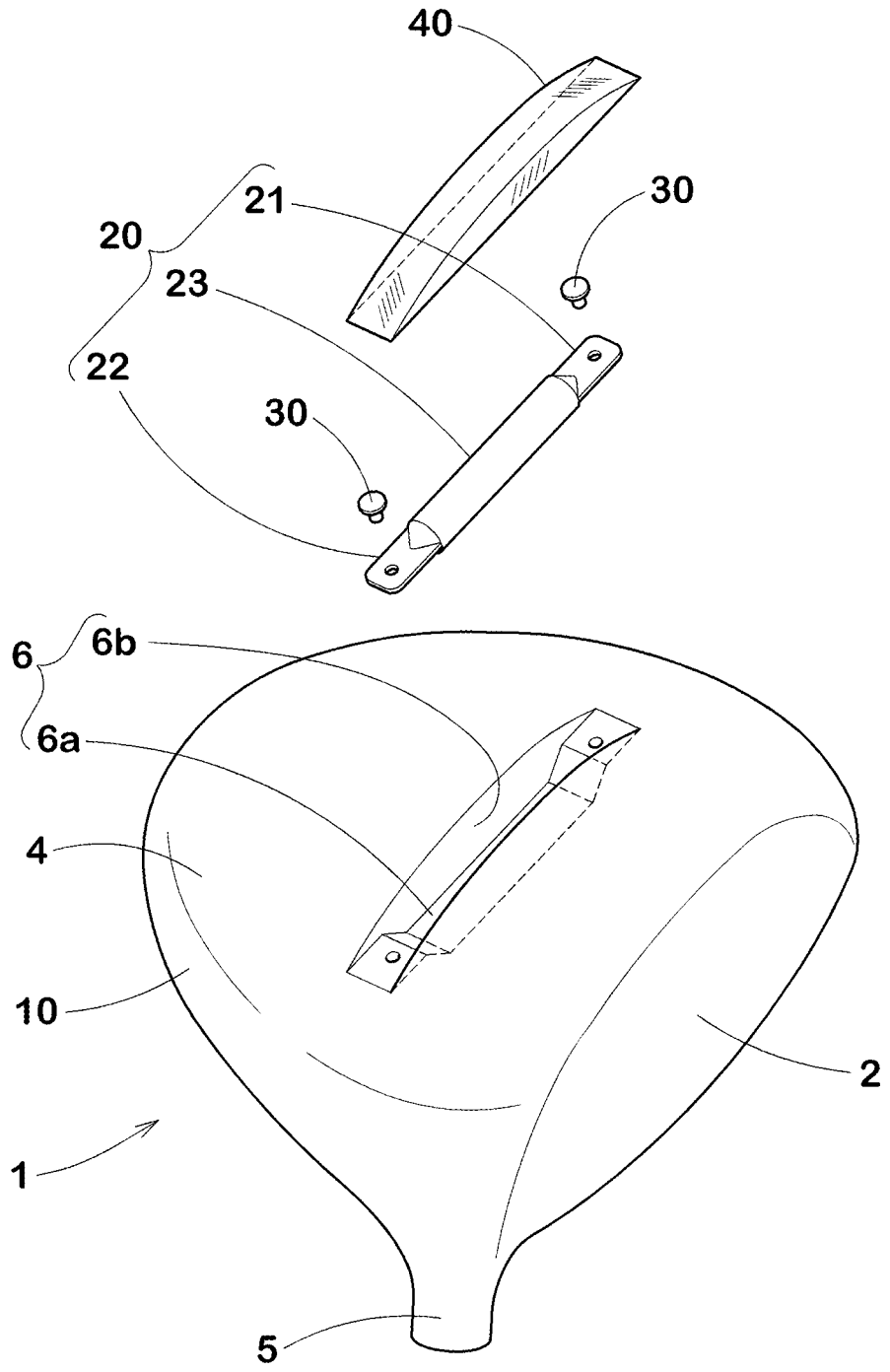
FIG. 5 is an exploded perspective view of the golf club head in accordance with the first embodiment.

The head 1 according to the present embodiment includes a head main body 10 and a reinforcing rod 20 (shown in FIG. 4).

[Head Main Body]

The head main body 10, for example, includes the striking face portion 2, a crown portion 3, a sole portion 4 and the hosel 5 integrally, and has a hollow portion therein which is omitted in FIGS. 1 to 4.

The striking face portion 2 is formed on the front side of the head 1 and has a striking face 2*a* for striking a ball. The striking face 2*a* may be provided with a plurality of grooves or so-called facelines (not illustrated) extending in the toe-heel direction.

The crown portion 3 extends rearward from an upper edge of the striking face portion 2 to form a top surface of the head 1. The hosel 5 is provided on a heel-side of the crown portion 3. The hosel 5 has the shaft insertion hole 5*a* for fixing a club shaft (not illustrated).

The sole portion 4 extends rearward from a lower edge of the striking face portion 2 to form a bottom surface of the head 1. For convenience, the sole portion 4 is a portion that can be seen in the bottom view of the head except for the hosel 5.

The head main body 10, for example, may be made of a metallic material. As the metallic material, for example, stainless steel, maraging steel, titanium alloy, magnesium alloy, aluminum alloy, and the like may be suitable. The head main body 10 according to the present embodiment is made of a titanium alloy. A part of the head 1 (for example, the crown portion 3) may be made of a non-metallic material such as fiber reinforced plastic.

[Recess of Head Main Body]

As illustrated in FIG. 4 and FIG. 5, in the present embodiment, the sole portion 4 of the head main body 10 is provided with a recess 6. The recess 6, in a bottom view of the head 1, elongates in the toe-heel direction. As apparent from FIG. 4, the recess 6 according to the present embodiment has a measurement (length) L thereof in the toe-heel direction greater than a measurement (width) W thereof in the front-rear direction of the head. The longitudinal direction of the recess 6 is defined by the center line of the width W.

As used herein, as to the recess 6, "extending in the toe-heel direction" means that the longitudinal direction of the recess 6 is not only parallel to the toe-heel direction of the head 1 in the head bottom view (or head plan view) as the present embodiment but also inclined at an angle equal to or less than 30 degrees with respect to the toe-heel direction of the head.

In the present embodiment, the recess 6 is formed into a groove shape which is depressed toward the hollow portion (inner side of the head). The groove shape, for example, includes a groove bottom 6*a* and a pair of groove walls 6*b*.

The sole portion 4 provided with the recess 6 tends to deflect easily in the front-rear direction of the head. Thus, when hitting a ball, the head main body 10 can deflect significantly in the front-rear direction of the head starting from the recess 6, which helps to improve rebound performance of the head 1.

In order to further improve the above effect, the recess 6 preferably has a width W equal to or more than 5 mm, more preferably equal to or more than 6 mm, still more preferably equal to or more than 7 mm. Similarly, the recess 6 preferably has a length L equal to or more than 20 mm, more preferably equal to or more than 25 mm, still more preferably equal to or more than 30 mm.

When the recess 6 becomes excessively large, durability of the head 1 may deteriorate. From this point of view, the recess 6 preferably has a width W equal to or less than 20 mm, more preferably equal to or less than 17 mm, still more preferably equal to or less than 15 mm. Similarly, the recess 6 preferably has a length L equal to or less than 120 mm, more preferably equal to or less than 110 mm, even more preferably equal to or less than 100 mm.

[Reinforcing Rod]

As illustrated in FIG. 4 and FIG. 5, the head 1 according to the present embodiment includes the reinforcing rod 20. The reinforcing rod 20 is provided on the crown portion 3 and/or the sole portion 4 where the recess 6 is provided. In the present embodiment, the recess 6 is provided on the sole portion 4, and thus the reinforcing rod 20 is fixed to the sole portion 4.

The reinforcing rod 20 according to the present embodiment has a rod shape defining a longitudinal direction thereof. In this embodiment, the reinforcing rod 20 extends in the toe-heel direction. As used herein, the reinforcing rod 20 "extends in the toe-heel direction" means that the longitudinal direction of the reinforcing rod 20 is not only parallel to the toe-heel direction but also inclined at an angle equal to or less than 30 degrees with respect to the toe-heel direction in a bottom view of the head (or a plan view of the head).

The reinforcing rod 20 can increase rigidity in the toe-heel direction of the head main body 10 and suppress deformation in this direction. In order to exert such effect, it is preferable that the reinforcing rod 20, for example, is made of a metallic material or a fiber reinforced plastic.

[Effect of Reinforcing Rod]

The impact energy when hitting a ball causes the head 1 to deflect in the front-rear direction of the head and to vibrate the sole portion 4 in the toe-heel direction (deformation). This vibration in the toe-heel direction corresponds to an energy loss from the viewpoint of improving rebound performance. The head 1 according to the present embodiment which includes the reinforcing rod 20 extending in the toe-heel direction can suppress the vibration in the toe-heel direction of the sole portion 4 when hitting a ball, so that the impact energy can intensively be used for deforming the head main body 10 in the front-rear direction. As a result, the head 1 according to the present embodiment can obtain a larger deflection along the flight direction of hit ball, and rebound performance of the head can further be improved.

[Example of Reinforcing Rod]

Preferably, the reinforcing rod 20, for example, is made of a material having a specific gravity greater than that of the head main body 10. In such an embodiment, the reinforcing rod 20 functions as a weight member which is capable of lowering the center of gravity of the head 1. In particular, the reinforcing rod 20 is preferably made of a metallic material having a specific gravity greater than that of the head main body 10. Further, by adjusting rigidity of the reinforcing rod 20, hitting sound of the head 1 can be adjusted, for example.

Figure 6:
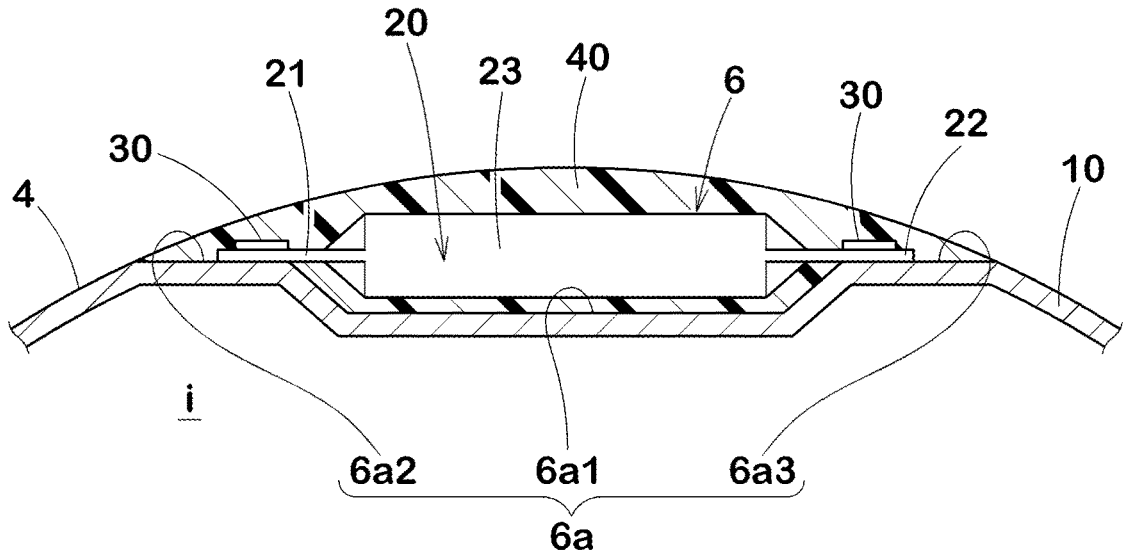
FIG. 6 is a cross-sectional view taken along the lines VI-VI of FIG. 4.
Figure 7:
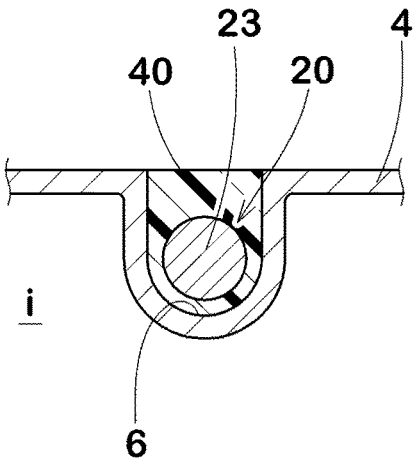
FIG. 7 is a cross-sectional view taken along the lines VII-VII of FIG. 4.

FIG. 6 and FIG. 7 are respectively cross-sectional views taken along the lines VI-VI and VII-VII of FIG. 4. As illustrated in FIGS. 5 to 7, the reinforcing rod 20, for example, includes a toe-side fixing portion 21 fixed to a toe side of the head main body 10, a heel-side fixing portion 22 fixed to a heel side of the head main body 10, and a bar main body 23 extending in the toe-heel direction between the toe-side fixing portion 21 and the heel-side fixing portion 22.

The bar main body 23 according to the present embodiment extends linearly, for example. The bar main body 23, for example, is formed into a cylindrical shape. In some other embodiments, the bar main body 23 may have various shapes such as a pipe, a prism, a triangular prism, and the like.

The toe-side fixing portion 21 and the heel-side fixing portion 22 are formed into a plate shape extending outwardly from both sides of the bar main body 23. Each of the fixing portions 21 and 22 has a thickness smaller than that of the bar main body 23. Each of the toe-side fixing portion 21 and the heel-side fixing portion 22 is fixed to the head main body 10 using a detachable fixing tool 30 such as a screw. Thus, the reinforcing rod 20 according to the present embodiment is detachable with respect to the head main body 10. Therefore, the head 1 according to the present embodiment allows users to attach and detach the reinforcing rod 20 to adjust rebound performance of the head. In some other embodiments, the toe-side fixing portion 21 and the heel-side fixing portion 22 may be fixed to the head main body 10 using a fixing means such as welding or adhesive.

As illustrates in FIG. 6, in the present embodiment, the toe-side fixing portion 21 and the heel-side fixing portion 22 are fixed to the groove bottom 6*a* of the recess 6. Specifically, the groove bottom 6*a* of the recess 6 includes a middle portion 6*a*1 having a first depth, a toe-side portion 6*a*2 having a second depth and a heel-side portion 6*a*3 having a third depth, wherein the second depth and the third depth are shallower than the first depth. The middle portion 6*a*1, the toe-side portion 6*a*2 and the heel-side portion 6*a*3, for example, are formed into planes which are in parallel with one another. The toe-side fixing portion 21 and the heel-side fixing portion 22 are fixed to the toe-side portion 6*a*2 and the heel-side portion 6*a*3 of the groove bottom 6*a*, respectively, and the bar main body 23 is located above the middle portion 6*a*1.

In the present embodiment, the recess 6 includes a pair of oblique walls extending obliquely with respect to the middle portion 6*a*1 from the middle portion 6*a*1 of the groove bottom 6*a* to each of the toe-side portion 6*a*2 and the heel-side portion 6*a*3. It is preferable that such a recess 6 can reduce rigidity of the head main body 10 in the front-rear direction, but it does not reduce rigidity in the toe-heel direction of the head main body 10 so much. This helps to suppress vibration of the head main body 10 in the toe-heel direction when hitting a ball.

At least a part of the bar main body 23, for example, is disposed in the middle recess. This aspect can reduce a height of the reinforcing rod 20 protruding from an outer surface of the sole portion 4. Thus, friction resistance to the ground as well as air resistance of the head 1 when swinging can be small so that reduction in head speed can be suppressed.

As apparent from FIG. 7, in the present embodiment, the entire region of the bar main body 23 is disposed within the recess 6. Thus, the bar main body 23 does not protrude from an outer surface of the sole portion 4. In FIG. 2 which is a front view of the head 1, the reinforcing rod 20 is completely hidden and invisible. Such an embodiment is preferable in that the above-mentioned effect is more effectively expressed.

Further, in FIG. 4 which is a bottom view of the head 1, the recess 6 has a contour shape that completely accommodates the reinforcing rod 20. The recess 6 according to the present embodiment has a rectangular shape similar to the reinforcing rod 20 in the bottom view.

As illustrated in FIG. 6 and FIG. 7, it is preferable that the bar main body 23 and the recess 6 are separated from one another. In the present embodiment, the bar main body 23 is separated without contact with either the groove bottom 6*a* or the groove walls 6*b* of the recess 6. In such an embodiment, when hitting a ball, the bar main body 23 can suppress vibration in the toe-heel direction of the sole portion 4 without limiting deflection in the front-back direction of the head main body 10. Thus, further improvement in rebound performance of the head 1 can be expected.

[Filler]

If there is a gap between the bar main body 23 and the recess 6, it may not comply with the Rules of Golf. From this point of view, it is preferable that a filler 40 is placed between the bar main body 23 and the recess 6. The filler 40, as illustrated in FIGS. 6 and 7, is configured to fill the entire region of the gap between the bar main body 23 and the recess 6 in any head section. In addition, the filler 40 according to the present embodiment is placed in the recess 6 so as to form an outer surface thereof that is continuous with an outer surface of the sole portion 4.

Preferably, the filler 40 is made of an elastic material such that deflection in the front-rear direction of the head main body 10 when hitting a ball are not limited. As such an elastic material, for example, elastomer, resin, rubber and the like may be suitable.

The filler 40, for example, may be prepared as a certain shape in advance, and then may be placed between the reinforcing rod 20 and the head main body 10. In another aspect, after the reinforcing rod 20 is fixed to the head main body 10, the filler 40 may be formed by pouring a fluid material into the gap between the reinforcing rod 20 and the head main body 10 and solidifying it. In addition, instead of the filler 40, or together with the filler 40, a cover member (not illustrated) that covers the recess 6 may be attached to the head main body 10.

Preferably, the filler 40 and cover member, for example, may be made of a transparent material. In this case, users can see the reinforcing rod 20 through the filler 40 and/or the cover member. This may present some advantageous effects that the appearance of the head 1 may be improved and high functionality of the head 1 may be appealed to users.

[Modification of Recess]

Figure 8:
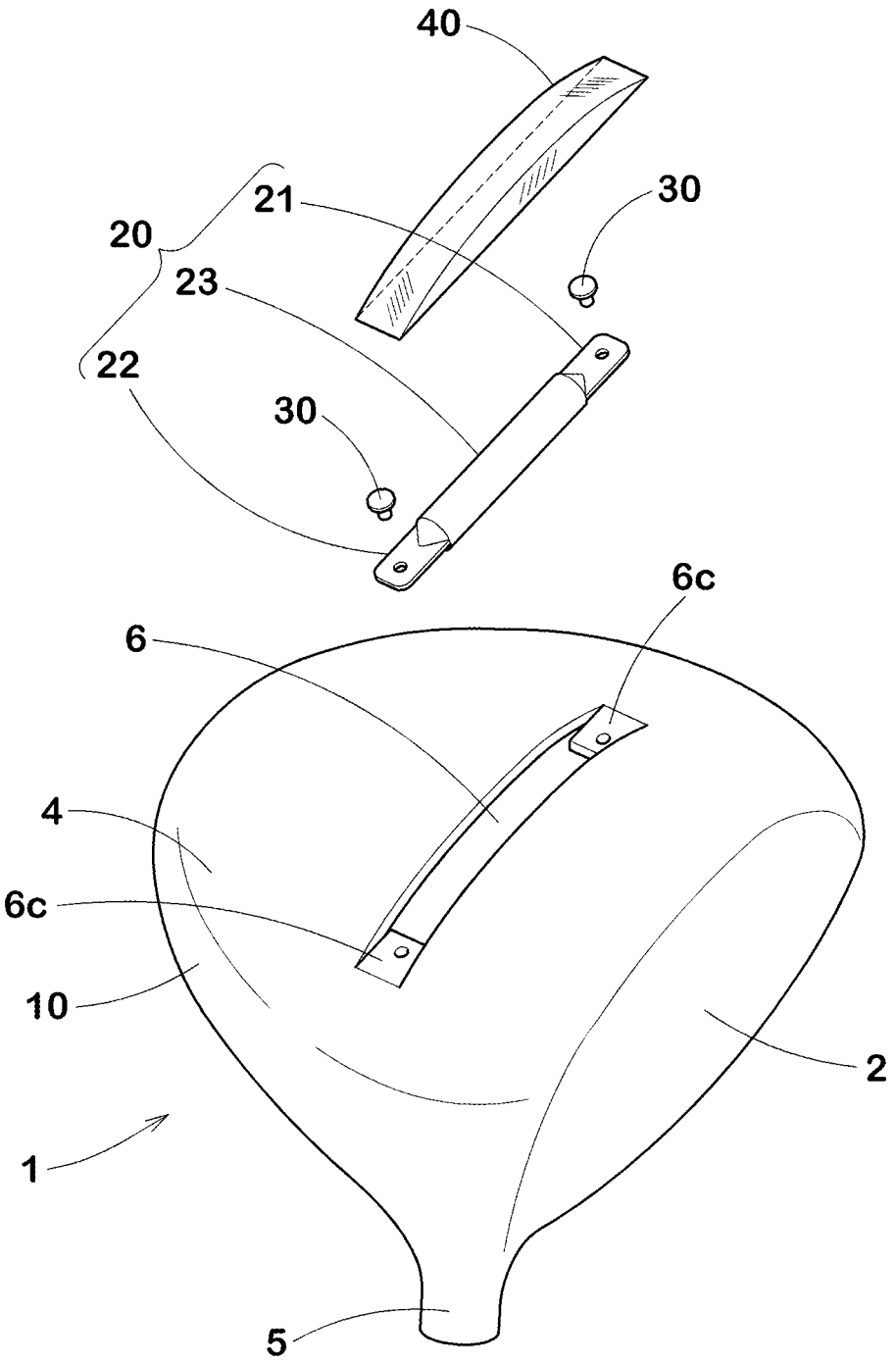
FIG. 8 is an exploded perspective view of the golf club head showing another variation of a recess.
Figure 9:
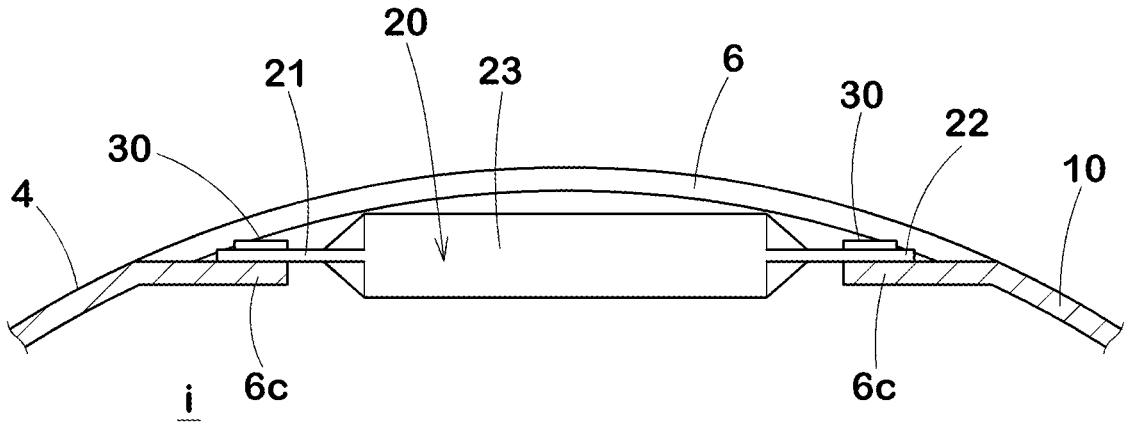
FIGS. 9 and 10 are cross-sectional views of a sole portion showing another variation of the recess.
Figure 10:
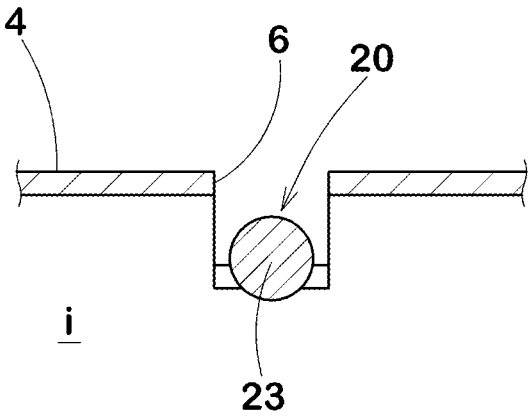

In FIGS. 4 to 6, the recess 6 is formed in a groove shape, but may be an opening. FIG. 8 s an exploded perspective view of the head 1 viewed from below. FIG. 9 and FIG. 10 are cross-sectional views of the sole portion 4 of the head 1 shown in FIG. 8. Here, the cross sections of FIG. 9 and FIG. 10 correspond to the same locations taken along the lines VI-VI and VII-VII of FIG. 4, respectively.

As illustrated in FIGS. 8 to 10, the recess 6 is formed into an opening that penetrates the sole portion 4. This opening extends in the toe-heel direction on the sole portion 4 and has a rectangular shape that is long in the toe-heel direction in the head plan view.

For example, receiving portions 6*c* and 6*c* for attaching the reinforcing rod 20 are formed on a toe side and a heel side of the recess 6, respectively. In a preferred embodiment, as illustrated in FIG. 9, the receiving portions 6*c* are provided at positions recessed from an outer surface of the sole portion 4.

The toe-side fixing portion 21 and the heel-side fixing portion 22 of the reinforcing rod 20 are fixed to the receiving portions 6*c* and 6*c* using the fixing tools 30. As a result, the bar main body 23 is fixed to the head main body 10 in a state separated from the recess 6 of the head main body 10.

Further, at least a part of the bar main body 23 of the reinforcing rod 20 is disposed in the recess 6. In this embodiment, the entire region of the bar main body 23 is disposed within the recess 6 (i.e., within the hollow portion i of the head main body 10).

Furthermore, in this embodiment, the toe-side fixing portion 21 and the heel-side fixing portion 22 of the reinforcing rod 20 are also located inside the recess 6 (i.e., inside the hollow portion i of the head main body 10). As a result, the reinforcing rod 20 does not protrude from an outer surface of the sole portion 4.

In this embodiment, since the recess 6 is an opening, the head 1 is more likely to deflect in the front-rear direction of the head when hitting a ball while suppressing vibration in the toe-heel direction of the head 1 by the reinforcing rod 20. Thus, rebound performance of the head 1 can further be improved.

Second Embodiment

Figure 11:
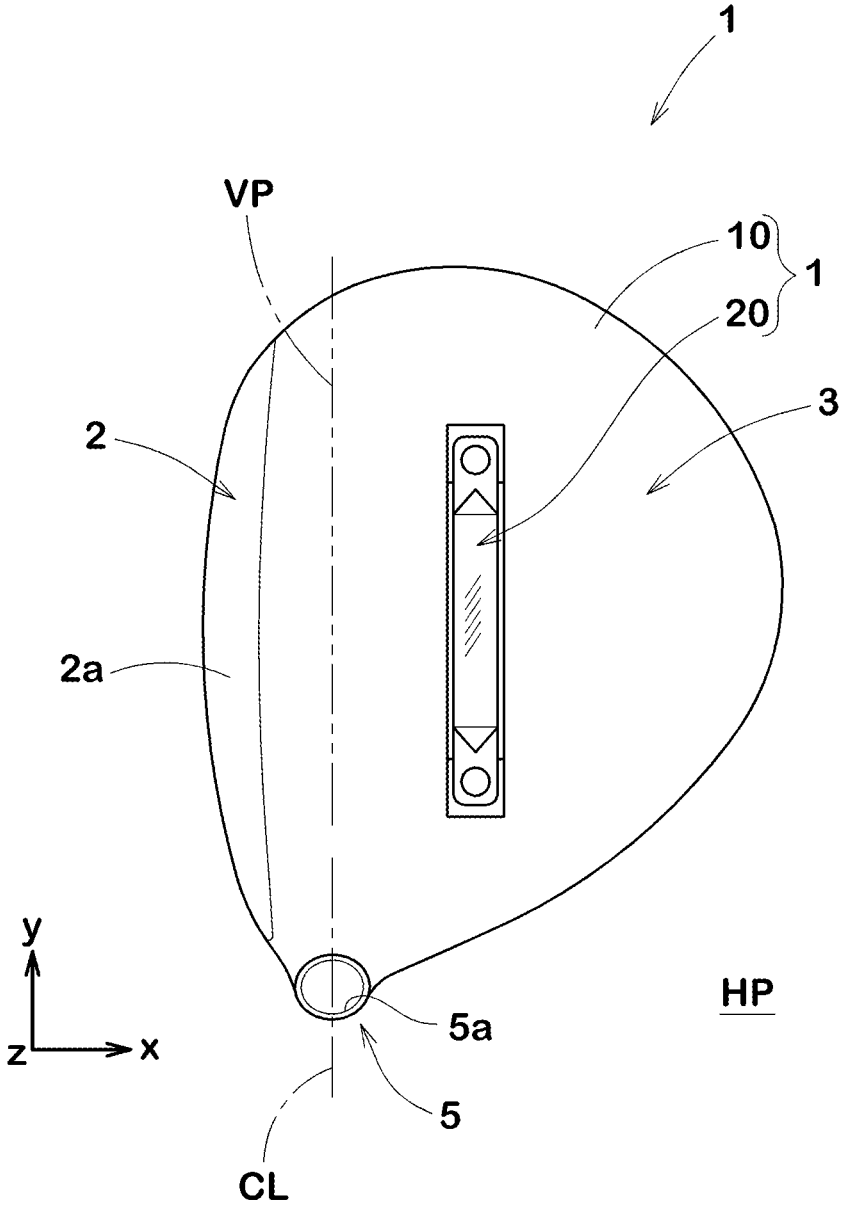
FIG. 11 is a plan view of the golf club head in accordance with the second embodiment.

FIG. 11 is a plan view of the head 1 in accordance with the second embodiment. As illustrated in FIG. 11, in the second embodiment, the recess 6 is formed in the crown portion 3, and the reinforcing rod 20 is fixed to the crown portion 3.

The impact energy when hitting a ball causes the head 1 to deflect in the front-rear direction of the head 1 and also to vibrate the crown portion 3 in the toe-heel direction (deformation). This vibration in the toe-heel direction corresponds to an energy loss from the viewpoint of improving rebound performance. The head 1 according to the present embodiment which includes the reinforcing rod 20 extending in the toe-heel direction in the crown portion 3 can suppress the vibration in the toe-heel direction of the crown portion 3 when hitting a ball, so that the impact energy can intensively be used for deforming the head main body 10 in the front-rear direction. As a result, the head 1 according to the present embodiment can obtain a larger deflection along the flight direction of hit ball, and rebound performance of the head can further be improved.

Although not illustrated, the recess 6 and the reinforcing rod 20 may be provided on both the crown portion 3 and the sole portion 4.

In addition, a plurality of the recesses 6 and the reinforcing rods 20 may be provided in the crown portion 3 and/or the sole portion 4.

While the particularly preferable embodiments in accordance with the present disclosure have been described in detail, the present disclosure is not limited to the illustrated embodiments, but can be modified and carried out in various aspects within the scope of the disclosure.

What is claimed is:

1. A golf club head having a hollow portion therein, the golf club head comprising:

a head main body comprising a striking face portion, a crown portion and a sole portion, the head main body being provided with a recess extending in a toe-heel direction of the club head on at least one of the crown portion and the sole portion; and a reinforcing rod being fixed to the recess and extending in the toe-heel direction of the club head, wherein the reinforcing rod comprises a toe-side fixing portion fixed to a toe side of the head main body, a heel-side fixing portion fixed to a heel side of the head main body, and a bar main body extending in the toe-heel direction between the toe-side fixing portion and the heel-side fixing portion, the bar main body is, at least partially, disposed in the recess, and a filler made of an elastic material is placed between the bar main body and the recess.

2. The golf club head according to claim 1, wherein the recess has a groove shape depressed toward the hollow portion.

3. The golf club head according to claim 1, wherein the recess is an opening.

4. The golf club head according to claim 1, wherein an entire region of the bar main body is disposed in the recess.

5. The golf club head according to claim 1, wherein the recess is provided on the sole portion.

6. The golf club head according to claim 1, wherein the recess is provided on the crown portion.

7. The golf club head according to claim 1, wherein the recess has a width W in a range of 5 to 20 mm in a front-rear direction of the head and a length L in a range of from 20 to 120 mm in the toe-heel direction of the head.

8. The golf club head according to claim 1, wherein the reinforcing rod is fixed to the recess using a detachable fixing tool.

9. The golf club head according to claim 1, wherein the recess has a groove shape having a groove bottom depressed toward the hollow portion, the groove bottom comprises a middle portion having a first depth, a toe-side portion having a second depth and a heel-side portion having a third depth, the second depth and the third depth being shallower than the first depth, the reinforcing rod comprises a toe-side fixing portion fixed to the toe-side portion of the groove bottom, a heel-side fixing portion fixed to the heel-side portion of the groove bottom and a bar main body extending in the toe-heel direction between the toe-side fixing portion and the heel-side fixing portion, and the bar main body is disposed above the middle portion of the groove bottom such that a part of the bar main body is disposed in the recess.

10. The golf club head according to claim 9, wherein the middle portion, the toe-side portion and the heel-side portion of the groove bottom are formed into planes which are in parallel with one another.

11. The golf club head according to claim 10, wherein the toe-side fixing portion and the heel-side fixing portion are formed into a plate shape extending outwardly in the toe-heel direction from both sides of the bar main body.

12. The golf club head according to claim 11, wherein each of the toe-side fixing portion and the heel-side fixing portion has a thickness smaller than that of the bar main body.

13. The golf club head according to claim 1, wherein an entire region of a gap between the bar main body and the recess, in any head cross-section, is filled with the filler.

14. The golf club head according to claim 1, wherein the filler is placed in the recess so as to form an outer surface thereof that is continuous with an outer surface of the sole portion so as not to form a step.

15. The golf club head according to claim 14, wherein the filler is placed in the recess so as to form an outer surface thereof that is continuous with an outer surface of the sole portion so as not to form a step.

16. The golf club head according to claim 1, wherein the filler is made of a transparent material such that the reinforcing rod is visible through the filler.

17. A golf club head having a hollow portion therein, the golf club head comprising:

a head main body comprising a striking face portion, a crown portion and a sole portion, the head main body being provided with a recess extending in a toe-heel direction of the club head on the crown portion; and a reinforcing rod being fixed to the recess and extending in the toe-heel direction of the club head.

18. A golf club head having a hollow portion therein, the golf club head comprising:

a head main body comprising a striking face portion, a crown portion and a sole portion, the head main body being provided with a recess extending in a toe-heel direction of the club head on at least one of the crown portion and the sole portion; and a reinforcing rod being fixed to the recess and extending in the toe-heel direction of the club head, wherein the recess has a groove shape having a groove bottom depressed toward the hollow portion, the groove bottom comprises a middle portion having a first depth, a toe-side portion having a second depth and a heel-side portion having a third depth, the second depth and the third depth being shallower than the first depth, the reinforcing rod comprises a toe-side fixing portion fixed to the toe-side portion of the groove bottom, a heel-side fixing portion fixed to the heel-side portion of the groove bottom and a bar main body extending in the toe-heel direction between the toe-side fixing portion and the heel-side fixing portion, and the bar main body is disposed above the middle portion of the groove bottom such that a part of the bar main body is disposed in the recess.

* * * * *